US009015960B2

(12) United States Patent
Hopkin et al.

(10) Patent No.: US 9,015,960 B2
(45) Date of Patent: Apr. 28, 2015

(54) DRYING OF WATER DAMAGED BUILDINGS

(75) Inventors: Ian David Hopkin, Vale of Glamorgan (GB); Jonathan Robert Jayne, Rhondda Cynon Taff (GB)

(73) Assignee: DBK David+Baader GmbH, Ruelzheim (DE)

( * ) Notice: Subject to any disclaimer, the term of this patent is extended or adjusted under 35 U.S.C. 154(b) by 277 days.

(21) Appl. No.: 13/413,342

(22) Filed: Mar. 6, 2012

(65) Prior Publication Data

US 2012/0227280 A1 Sep. 13, 2012

(30) Foreign Application Priority Data

Mar. 8, 2011 (GB) ..... 1103899.9
Feb. 23, 2012 (GB) ..... 1203155.5

(51) Int. Cl.

| | |
|---|---|
| ***F26B 3/34*** | (2006.01) |
| ***E04B 1/70*** | (2006.01) |
| ***F26B 3/04*** | (2006.01) |
| ***F26B 9/02*** | (2006.01) |

(52) U.S. Cl.

CPC ..... *F26B 3/04* (2013.01); *E04B 1/7069* (2013.01); *F26B 9/02* (2013.01); *E04B 1/7015* (2013.01)

(58) Field of Classification Search

CPC ..... F26B 3/00; F26B 3/04; F26B 3/18; F26B 3/34; F26B 7/002; F26B 20/00; F26B 21/006; F26B 21/022; F26B 21/06; F26B 21/08; F26B 21/10

USPC ..... 34/381, 417, 212, 217; 432/227; 236/94 A, 44 C; 165/7, 49, 104.31, 111; 62/271, 333, 94, 160

See application file for complete search history.

(56) References Cited

U.S. PATENT DOCUMENTS

| | | | | | |
|---|---|---|---|---|---|
| 4,913,222 | A | * | 4/1990 | Cowan | 165/7 |
| 5,165,969 | A | * | 11/1992 | Barlett et al. | 427/483 |
| 5,228,209 | A | * | 7/1993 | Brunner | 34/417 |
| 5,675,906 | A | * | 10/1997 | Li et al. | 34/77 |
| 5,761,827 | A | * | 6/1998 | Guasch | 34/413 |
| RE36,728 | E | * | 6/2000 | Ishii | 34/396 |
| 6,119,364 | A | * | 9/2000 | Elder | 34/212 |
| 6,161,763 | A | | 12/2000 | Reuter | |
| 6,327,812 | B1 | | 12/2001 | Hedman et al. | |

(Continued)

FOREIGN PATENT DOCUMENTS

| | | |
|---|---|---|
| EP | 0505116 | 9/1992 |
| GB | 2289752 | 11/1995 |

(Continued)

*Primary Examiner* — Steve M Gravini
(74) *Attorney, Agent, or Firm* — Simpson & Simpson, PLLC

(57) ABSTRACT

A drying apparatus for temporary location within a damp or waterlogged room is disclosed. The apparatus includes sensors to sense the level of temperature and humidity within the room, a heater to provide heat for the room, an air circulation fan for selectively circulating heated air within the room or selectively exhausting warm and humid air from the room and for allowing outside ambient air into the room. The apparatus being adapted to cyclically continue until the sensed humidity reaches a required level, the apparatus thereafter indicating, directly or indirectly, the completion of the drying process. A method of drying a room using such apparatus is also disclosed which employs a technique whereby the rate of change of the temperature increase is used to determine when humid air should be exhausted from the room. A time limit can also be use to determine when said exhausting takes place.

16 Claims, 6 Drawing Sheets

(56) References Cited

U.S. PATENT DOCUMENTS

| | | | | |
|---|---|---|---|---|
| 6,345,450 | B1 * | 2/2002 | Elder | 34/396 |
| 6,457,258 | B1 | 10/2002 | Cressy et al. | |
| 6,537,600 | B1 * | 3/2003 | Meldrum | 426/102 |
| 6,662,467 | B2 | 12/2003 | Cressy et al. | |
| 6,884,866 | B2 * | 4/2005 | Bronshtein et al. | 528/486 |
| 6,892,491 | B2 | 5/2005 | Hedman et al. | |
| 7,182,268 | B2 * | 2/2007 | Kawahara | 236/44 A |
| 7,403,126 | B2 * | 7/2008 | Pedraza et al. | 340/604 |
| 7,624,740 | B2 * | 12/2009 | Lipscomb et al. | 131/303 |
| 7,837,932 | B2 | 11/2010 | Hedman et al. | |
| 8,006,407 | B2 * | 8/2011 | Anderson | 34/381 |
| 8,397,400 | B2 * | 3/2013 | Choo et al. | 34/396 |
| 8,412,383 | B2 * | 4/2013 | Moretto | 700/282 |
| 8,438,753 | B2 * | 5/2013 | Martin | 34/381 |
| 8,468,716 | B1 * | 6/2013 | Walker et al. | 34/435 |
| 8,621,764 | B2 * | 1/2014 | Puckett | 34/443 |
| 2001/0004813 | A1 | 6/2001 | Hedman | |
| 2002/0004995 | A1 * | 1/2002 | France et al. | 34/524 |
| 2002/0066223 | A1 | 6/2002 | Hedman et al. | |
| 2004/0028554 | A1 | 2/2004 | Hedman | |
| 2004/0028583 | A1 | 2/2004 | Hedman | |
| 2005/0013727 | A1 | 1/2005 | Hedman | |
| 2005/0220662 | A1 | 10/2005 | Hedman | |
| 2006/0185819 | A1 | 8/2006 | Bourgault et al. | |
| 2007/0003899 | A1 * | 1/2007 | Lipscomb et al. | 432/500 |
| 2009/0151190 | A1 | 6/2009 | Anderson et al. | |
| 2010/0011612 | A1 * | 1/2010 | Jayne et al. | 34/417 |
| 2012/0227280 | A1 * | 9/2012 | Hopkin et al. | 34/492 |

FOREIGN PATENT DOCUMENTS

| | | | | |
|---|---|---|---|---|
| GB | 2375812 | | 11/2002 | |
| GB | 2462066 | | 1/2010 | |
| GB | 2488873 | A * | 9/2012 | |
| JP | 2001321629 | A * | 11/2001 | B01D 53/02 |
| WO | 9621834 | | 7/1996 | |
| WO | 2004011865 | | 2/2004 | |
| WO | 2008039149 | | 4/2008 | |
| WO | 2009038534 | | 3/2009 | |
| WO | 2010007380 | | 1/2010 | |

* cited by examiner

DRYING OF WATER DAMAGED BUILDINGS

CROSS-REFERENCE TO RELATED APPLICATIONS

This patent claims priority from United Kingdom Patent Application No. GB1103899.9, filed Mar. 8, 2011, and United Kingdom Patent Application No. GB1203155.5, filed Feb. 23, 2012, which applications are incorporated herein by reference in their entireties.

FIELD OF THE INVENTION

This invention relates to methods and apparatus for drying damp or water damaged buildings, such as those that have been damaged by floods, particularly, but not exclusively, portable apparatus for temporary location in a room of previously flooded building, to dry that room.

BACKGROUND OF THE INVENTION

With apparent increases in global warming causing increased flooding there has been correspondingly increased interest in methods of ameliorating the effects of flooding, more particularly in the knowledge that with flood prevention being extremely difficult the focus of attention is increasingly directed towards limiting the damage caused by flooding and decreasing the time taken to the drying of water damaged rooms in buildings such that residential or commercial buildings can, be reoccupied in the shortest possible time.

Conventional methods for drying rooms in damp or water damaged buildings generally take three forms. The first is dehumidification by the use of refrigeration techniques. This usually involves the removal of moisture from the air using refrigerated surfaces which allow water to condense from the air and thereafter be removed. A second method is dehumidification using desiccants such as Silica Gel. The third method of drying waterlogged and water damaged rooms is by direct heating. This raises the temperature of the air in the room and the moisture in the walls and floor is removed due to accelerated evaporation.

These three conventional methods of forced drying wet or waterlogged rooms have several known disadvantages. Refrigerant and desiccant technology has known inefficiency outside the optimum temperature/relative humidity range within the area being dried. Also, heat drying alone creates a rapid increase in relative humidity within the area being dried resulting in secondary damage from the heat itself or prolonged drying or cessation of the drying efficiency. Similarly, with the methods involving dehumidification using the refrigeration or desiccant process, or by using direct heating to raise the temperature of the air in the room, unless the moisture level is constantly monitored there is no indication as to when the process has been satisfactorily completed, leading to increased risk of secondary damage, uncertainty and the potential for energy wastage after the initial objective of drying a damp or waterlogged room has been achieved.

An alternative approach is described in WO2010/007380 (PCT/GB2009/001770), the contents of which are incorporated herein by reference. In that document, a method for drying waterlogged or water damaged buildings is described which constantly monitors the effectiveness of the drying process by reference to several criteria including air temperature, air humidity, wall and floor temperature, humidity and electrical conductivity.

In particular the method described in WO2010/007380 includes drying damp or waterlogged rooms within a building including the steps of sealing the room from outside ambient air ingress and heating it internally until the inside ambient air therewithin is warm and humid following surface evaporation of water in the room, thereafter exhausting the warm and humid air from the room and drawing in outside ambient air, and monitoring humidity levels within the room, the sequence continuing in cycle until an indication is received that the room is suitably dry.

SUMMARY OF THE INVENTION

Improvements in the prior technique have been made which improve the efficiency of the drying method. In practice it has now been found that the drier a room becomes the less heat is needed for the temperature threshold which triggers said exhausting. For example as less evaporation occurs in a room then less latent heat is taken, meaning that the room can be heated to a higher temperature with the same energy in successive cycles.

The drying equipment is, in embodiments intended to be powered by electricity. This means that there is a finite amount of heating power available, usually governed by the safe power rating of the electrical supply. Additionally it has now been found that for a given energy input, the rate of increase of temperature and humidity will diminish or reach zero over time, which phenomena can be used to advantage in the drying techniques described herein.

According to a first aspect the invention comprises, a cyclic room drying method including initiating a room drying process including the steps of: heating the air in the room and circulating said heated air around the room; continually or periodically monitoring the room temperature and, optionally, the humidity; the temperature having a preselected maximum; exhausting the heated air in the room following the first to occur of either a) the attaining of predetermined characteristics below the preselected maximum temperature and, optionally, level of humidity of said monitored room, or b) a predetermined time period; introducing fresh air into the room; and, repeating the steps above until a suitably dry room is obtained.

In a preferred embodiment exhausting is initiated after a heating and circulation period of approximately 1 to 3 hours, more preferably approximately 2 hours, or sooner if said predetermined temperature characteristics are attained within said period.

In a preferred embodiment, the characteristics are a reduction in the rate of increase of temperature over time.

Preferably the rate of increase is zero or approaching zero.

In a preferred embodiment the room temperature at which the exhausting occurs increases with successive drying cycles towards the preselected maximum.

In a preferred embodiment, the temperature and/or humidity has a preselected maximum.

In this way an operator can set a maximum temperature or humidity in the room, say 40 degrees Celsius, and when obtained—often in the latter stages of the drying process—that maximum can be used to trigger exhausting of the humid air. Thus, the air can be exhausted before the predetermined room temperature characteristics are attained. This prevents the room becoming too hot or too humid.

In a preferred embodiment, said fresh air may be drawn from either outside the building in which the room is located, or from another room in the building. The advantage of using air from another room is that no positive air pressure is generated in the building and so humid air is not forced into the walls of the room.

Where relatively cold air is drawn into the room being dried it is preferably pre-heated to reduce the risk of condensation.

In a preferred embodiment, relative humidity is provided by a humidity reference in the building from where the room being dried is located.

In accordance with a second aspect of the invention there is provided drying apparatus for use in a damp or waterlogged room, the apparatus including sensing means to sense room humidity and air temperature in the room, heating means to provide heat for the room, air circulation means for selectively circulating heated air within the room or selectively exhausting warm and humid air from the room and for allowing outside ambient air into the room, the apparatus further including a circuit arranged to control the drying method according to the first aspect of the invention as mentioned above.

Conveniently, the apparatus includes a heater, such as an electric heater, coupled via ducting to air circulation fans such as an inlet fan and an outlet fan, the inlet fan selectively either recirculating air within the room until chosen temperature or humidity characteristics have been attained or a predetermined time period has been reached, or, via the use of an air intake valve, drawing outside ambient air into the room to replace saturated air expelled by the exhaust fan at the end of each drying cycle.

Preferably, the heater is also used to pre-heat outside ambient air to reduce the risk of condensation occurring in the room being dried.

Conveniently, the circuit is in the form of processor which receives sensed signals from sensors in the room and on or in the apparatus which sense room air temperature and/or room air or other humidity. This may conveniently be achieved by temperature and humidity sensors positioned at the intake end of the intake fan and by corresponding sensors upstream of the exhaust fan, which may be further enhanced by sensors embedded the room in chosen locations, such as in or on the floor, walls and ceiling, to detect temperature or humidity levels or electrical conductivity indicative of humidity levels.

Conveniently, the apparatus also includes means for recording energy used during the drying process so as to maximise the energy efficiency, and a timer for recording data at required intervals, such as hourly.

Although the apparatus may be stand alone and simply operate until it detects that the room within which it is installed is sufficiently dry, it may instead advantageously include a remote communications facility which indicates to a monitor of the apparatus that the room is sufficiently dry for the apparatus to be removed and relocated if necessary to dry another room.

Preferably, the apparatus is portable and temporarily locatable in the room for the drying.

BRIEF DESCRIPTION OF THE DRAWINGS

The invention will now be described, by way of example only, with reference to the accompanying drawings in which.

DETAILED DESCRIPTION OF THE INVENTION

Figure 1:
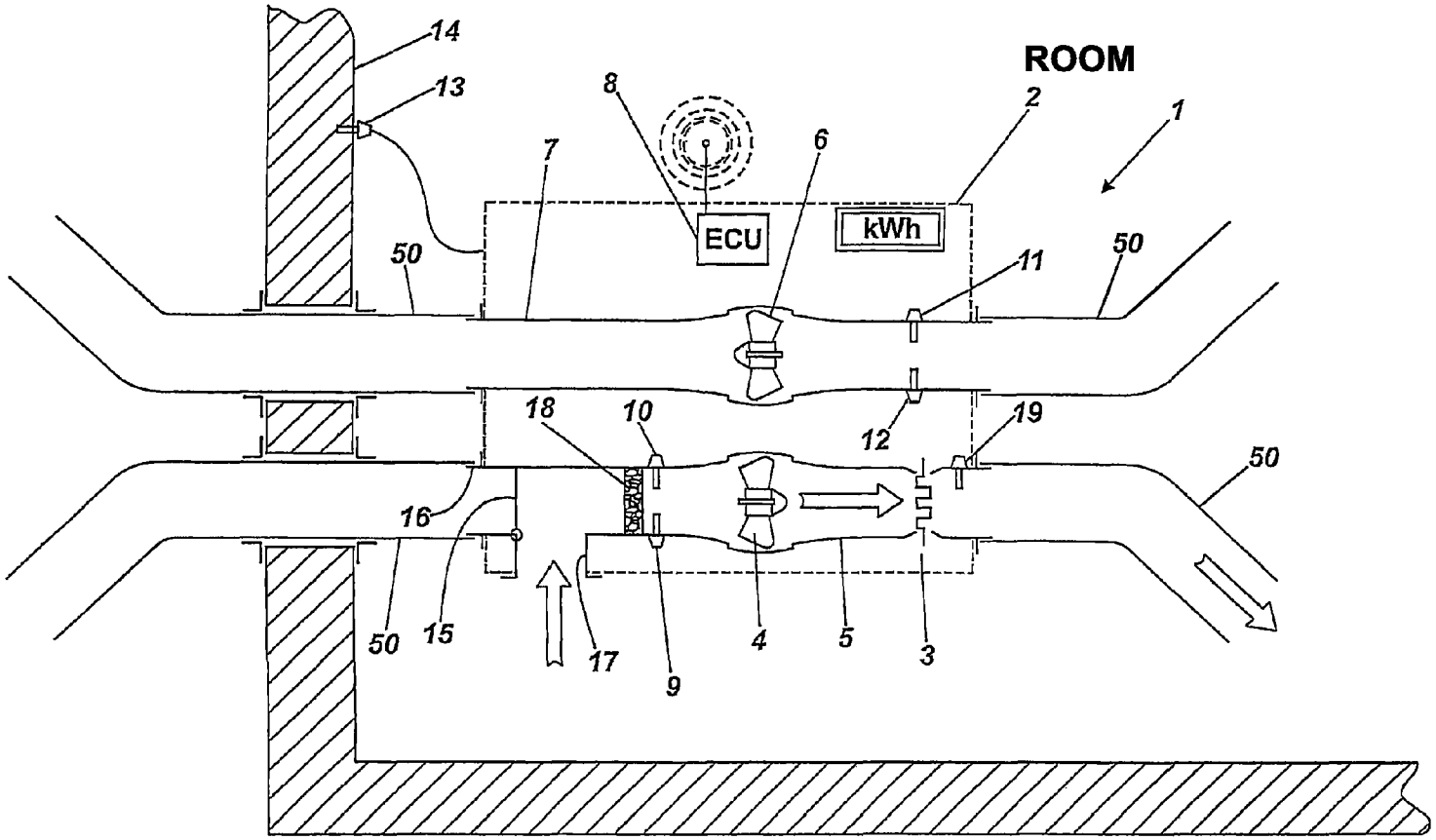
FIG. 1 is a schematic drawing of a drying apparatus.

Turning to FIG. 1 there is shown a schematic view of part of a waterlogged room to be dried in accordance with the method of the invention in which drying apparatus shown generally at 1 includes a heater housing 2 containing a heater element 3 and inlet fan 4 housed within an inlet duct 5 as well as outlet fan 6 and outlet duct 7, collectively by which heated air may be circulated within the room and exhausted from it when required.

The apparatus 1 also includes an electronic control unit (ECU) 8 which monitors sensed signals from a temperature sensor 9 and a humidity sensor 10 upstream of the air intake fan 4 as well as exhaust temperature sensor 11 and exhaust humidity sensor 12 upstream of the exhaust fan 6. In addition, the ECU 8 also monitors via a wall-mounted humidity or conductivity sensor 13 the amount of water in the wall 14 of the room being dried. Sensor 13 or further sensors may be mounted anywhere in the room, for example on the floor or on the ceiling. Control and variation of the air circulation within and without the room is by means of a simple gate valve 15 positioned between an outside ambient air inlet duct 16 and a room air inlet 17, with an air filter 18 being positioned within the air inlet duct 5 immediately downstream thereof.

A further temperature sensor 19 is provided immediately downstream of the heater element 3 to indicate a blocked filter 18 or loss of air flow due to, e.g., failure of the inlet fan 4.

In operation in accordance with the mode shown in FIG. 1 it will be apparent that heated air within the room is simply being recirculated, and in accordance with the method of the invention, this continues until the ECU 8 senses that the required saturation point has been reached, via sensed signals received from the various sensors 9,10,11,12 and, to a lesser extent, the wall sensor 13. At this point, the apparatus 1 is switched by ECU 8 to the mode illustrated in FIG. 2 in which it will be seen that the gate valve 15 has been rotated through 90 degrees via a command from the ECU 8 such that it only allows outside ambient air into the room via the ambient air inlet 16, which then passes through the filter 18 and is monitored by the temperature and humidity sensors 9,10 and then heated via the heater element 3 to thereafter be monitored for temperature and humidity by sensors 11 and 12.

In this exhaust mode the apparatus 1 is effectively removing warm humid air from the room and replacing it with outside ambient air, but which is preheated as it enters the room thereby minimising the possible effects of condensation caused by cold outside ambient air entering the heated room.

The ECU 8 may conveniently include a radio transmitter or other remote control sensing and control functions, for example for providing a warning that the room is dry following successive cycles of air recirculation and air exhaust. In this way, maximum use is made of the property of the air within the room to absorb water until it reaches a required temperature or saturation point whereafter all the air in the room is then exhausted to be replaced by fresh, outside ambient but warmed air of a relatively low humidity which can thereafter more readily absorb evaporated water in the room at the least cost in terms of energy.

Figure 2:
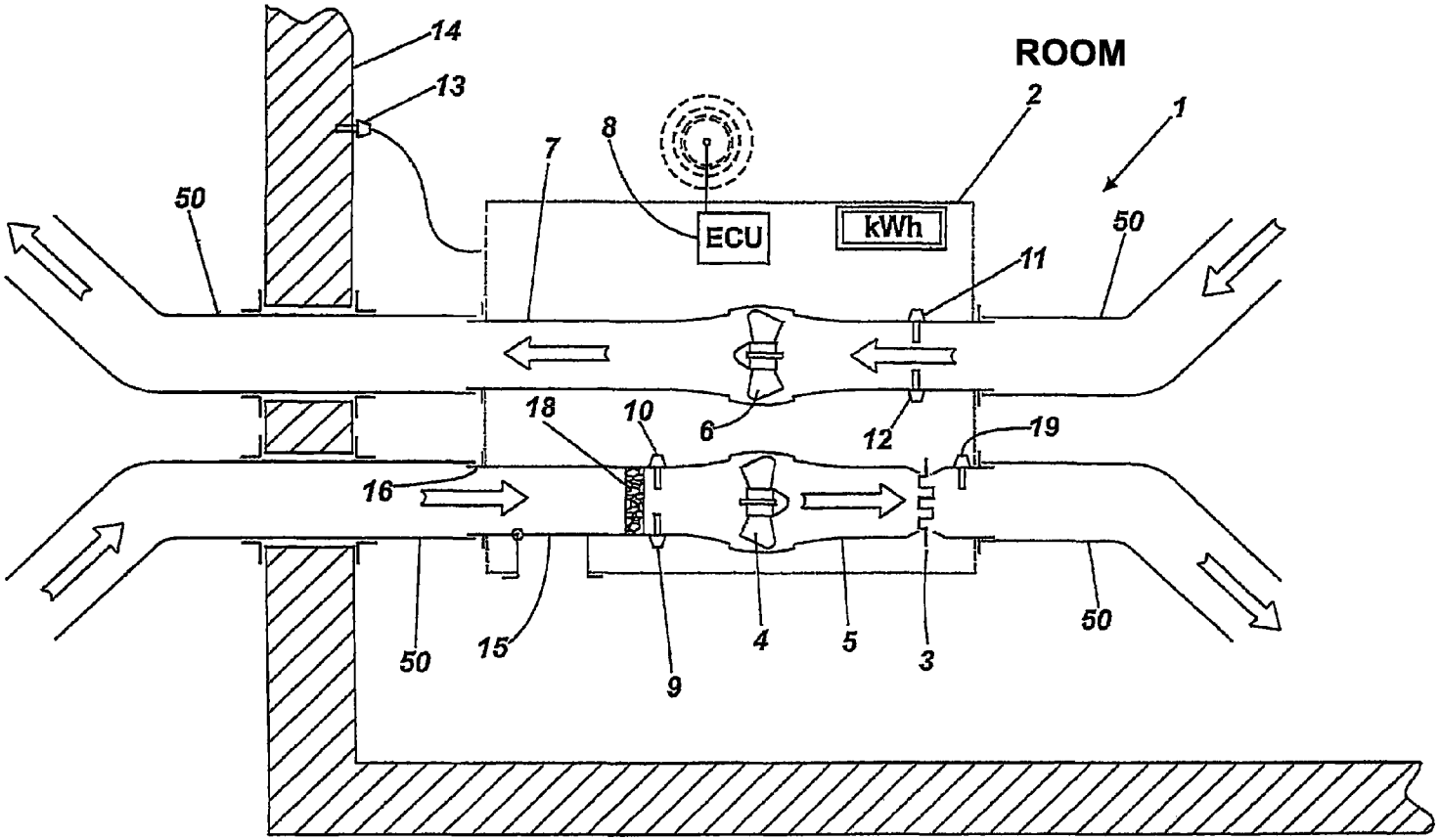
FIG. 2 is a schematic view of the apparatus of FIG. 1 operating in an air exchange/removal mode.
Figure 3:
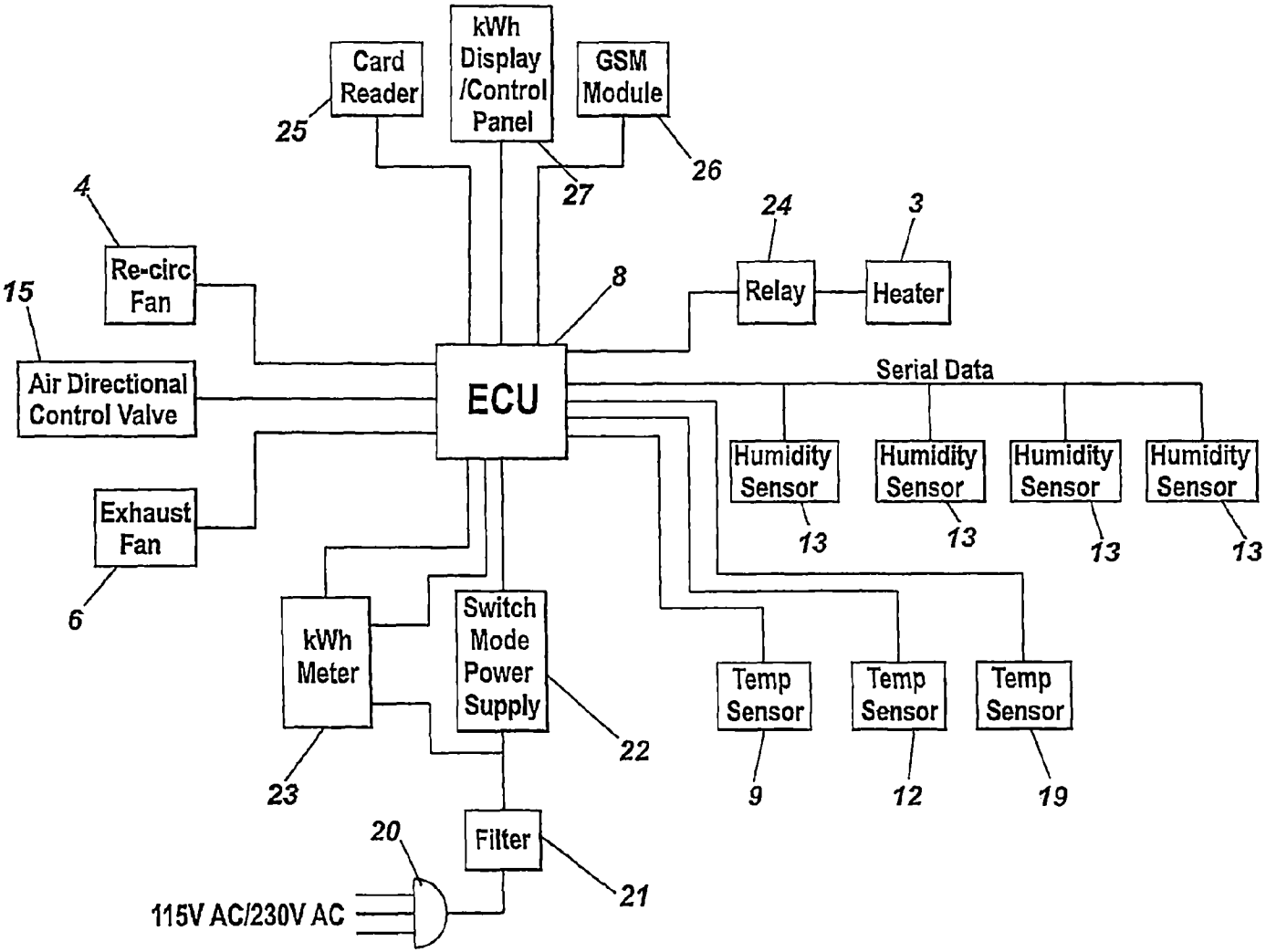
FIG. 3 is a schematic circuit diagram for operating the apparatus of FIGS. 1 and 2 and performing the method of the first aspect of the invention.
Figure 6:
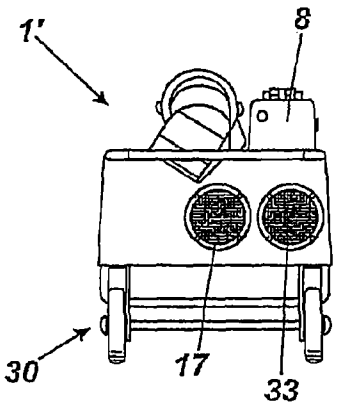
FIGS. 4 to 7 show one embodiment of the apparatus of the invention.
Figure 5:
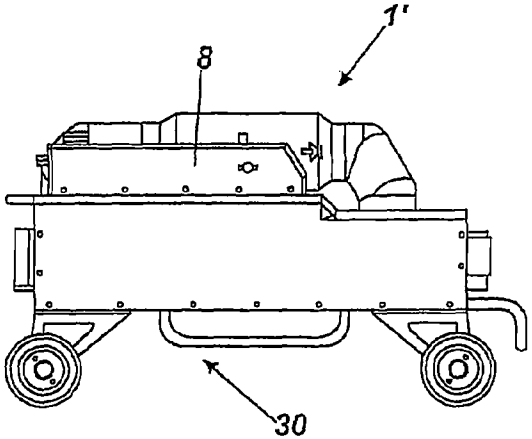
Figure 4:
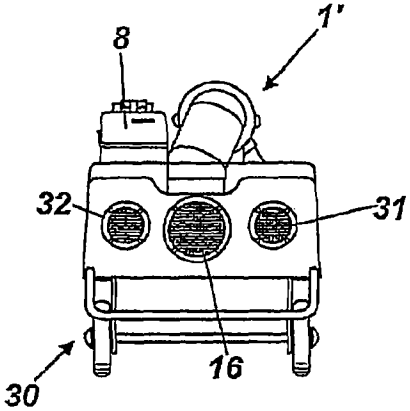
Figure 7:
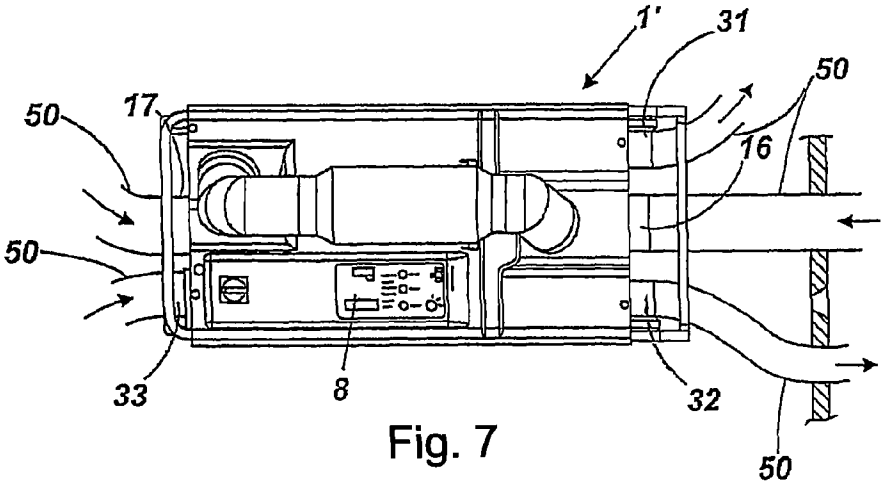

Turning now to FIG. 3 there is shown a simplified circuit diagram for the apparatus described in FIGS. 1 and 2 where like numbers are given to like parts. As is shown, most of the various components are connected to the ECU 8, which therefore controls the method and apparatus described earlier. As well as various temperature and humidity sensors 9,10,11,12 and 19 being arranged within the apparatus 1 there are also humidity sensors 13 which may conveniently be positioned on floor, wall and ceiling surfaces of the room within which the apparatus 1 is installed. The apparatus 1 may conveniently be provided with a mains electricity supply 20 which passes through a regulating filter 21 to reduce RF emissions and the electrical power is then supplied via a switch mode power supply unit 22 and measured by a meter 23. With the main electrical drain being via the heater 3 a control relay 24 is incorporated within the apparatus 1 upstream of the heater 3 to provide a mechanical cut-out in the circuit to prevent over temperature in the event of reduced air flow.

The ECU 8 may conveniently include or have communications access to a card reader 25 to store logged data from the drying process, such as temperature, humidity, energy used, and any error signals. This may be uploaded to a PC via a smart card for subsequently inspecting the data stored during the drying cycle. Alternatively, remote communication may be via a GSM module 26 to thereby remotely indicate when a room within which the apparatus 1 has been installed has been dried. A power consumption and control panel 27, which may be incorporated within the apparatus or remote therefrom, monitors and displays the status of the drying operation and the apparatus 1, and may also be used to modify the mode of operation by, for example, extending the drying cycle for a period beyond the indicated or projected time to dry a given room.

While the invention has been described in fairly simplistic terms it will be understood that many variations are possible which allow for particular drying cycles to be adopted depending upon prevailing conditions.

Two modes of drying a room are described in detail below.

Figure 8:
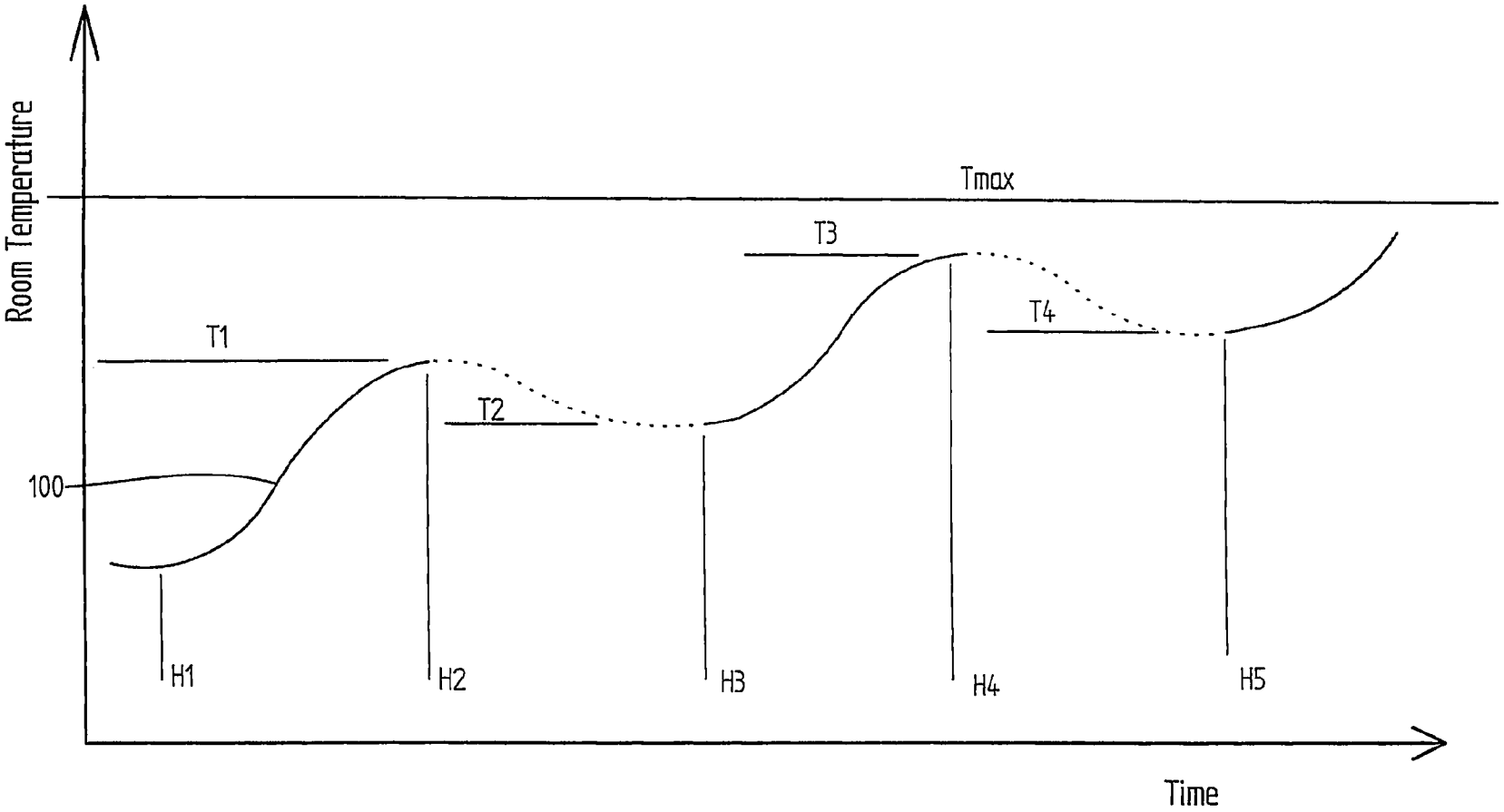
FIG. 8 shows a temperature graph illustrating the operation of the apparatus illustrated in the above Figures; and, FIG. 9 shows a temperature and humidity graph illustrating the operation of the apparatus according to the invention as compared with the operation of the prior art apparatus disclosed in WO2010/007380.

With reference to FIG. 8, it is intended that room air is heated and circulated as described above. The graph in FIG. 8 shows room temperature along the vertical axis, and time along the horizontal axis. In normal operation, the temperature will increase as the heating and circulation take place. This increase is represented by line 100. At some point, the rate at which the temperature increases will slow down, or approach zero. In other words, the gradient of curve will decrease with time and if left heating and circulating the gradient of the line will substantially level out. At this stage drying becomes inefficient because further energy input does not lead to any significant further drying. The gradient of the line 100 is monitored using an algorithm running in the ECU. Where multiple sensors are employed, then average values can be used. The rate of change of the values of the sensors employed is monitored continually or periodically and, as that rate of change approaches zero, the drying apparatus is caused to exhaust the humid air in a manner defined above, i.e., at T1 on the graph.

The temperature is further monitored and the heating and recirculation is recommenced either when a specific value for temperature is reached, or a percentage of the maximum value attained prior to the exhausting can be used to trigger the recommencing of the heating, i.e., T2.

Thus, the chain dotted parts of the line 100 represent the exhausting part of the drying cycle. It will be noted that maximum T3 is higher than maximum T1. This is because the room is becoming dryer and so for the same energy input, the temperature will increase, for example as less latent heat is absorbed in the room and where the walls of the room become less thermally conductive. So the temperature at which the gradient of the line 100 is zero will change as the room becomes dryer, and so the speed at which the room can be dried can be quicker than simply exhausting at a fixed threshold.

In practice, it may be that the room keeps getting warmer or more humid over a long period, for example a well sealed room, which can reach a saturation point. This is not desirable because it will increase the drying time. So in practice, the apparatus has a time limit in which to attain the characteristic of a shallow or zero gradient for line 100. If after a period, H1 to H2, if a suitable gradient of line 100 is not attained, then the apparatus will automatically switch to exhaust the room air and after a further period (H2 to H3), switch back to heating and recirculating (H3 to H4) the now fresh air in the room, and so on. The period is preferably 1 to 3 hours, more preferably 2 hours, and the further period is preferably 6 to 10 hours, more preferably 8 hours.

In addition, it may be that a maximum temperature or humidity should not be exceeded in a room, for example, to avoid damaging an old building. In that case a maximum temperature or (Tmax) can be set. Once set this value can be used as a maximum which triggers the exhausting of the room air. A maximum humidity can also be used to trigger the exhausting cycle.

The apparatus can stop functioning when no progress is being made in reducing the humidity of the room. Alternatively or as well as, an initial value of humidity can be sensed or recorded, for example the humidity of a dry part of the building. The apparatus can work toward that value as a target for completing the drying of the room. This target need not necessarily be attained using the techniques described above.

Figure 9:
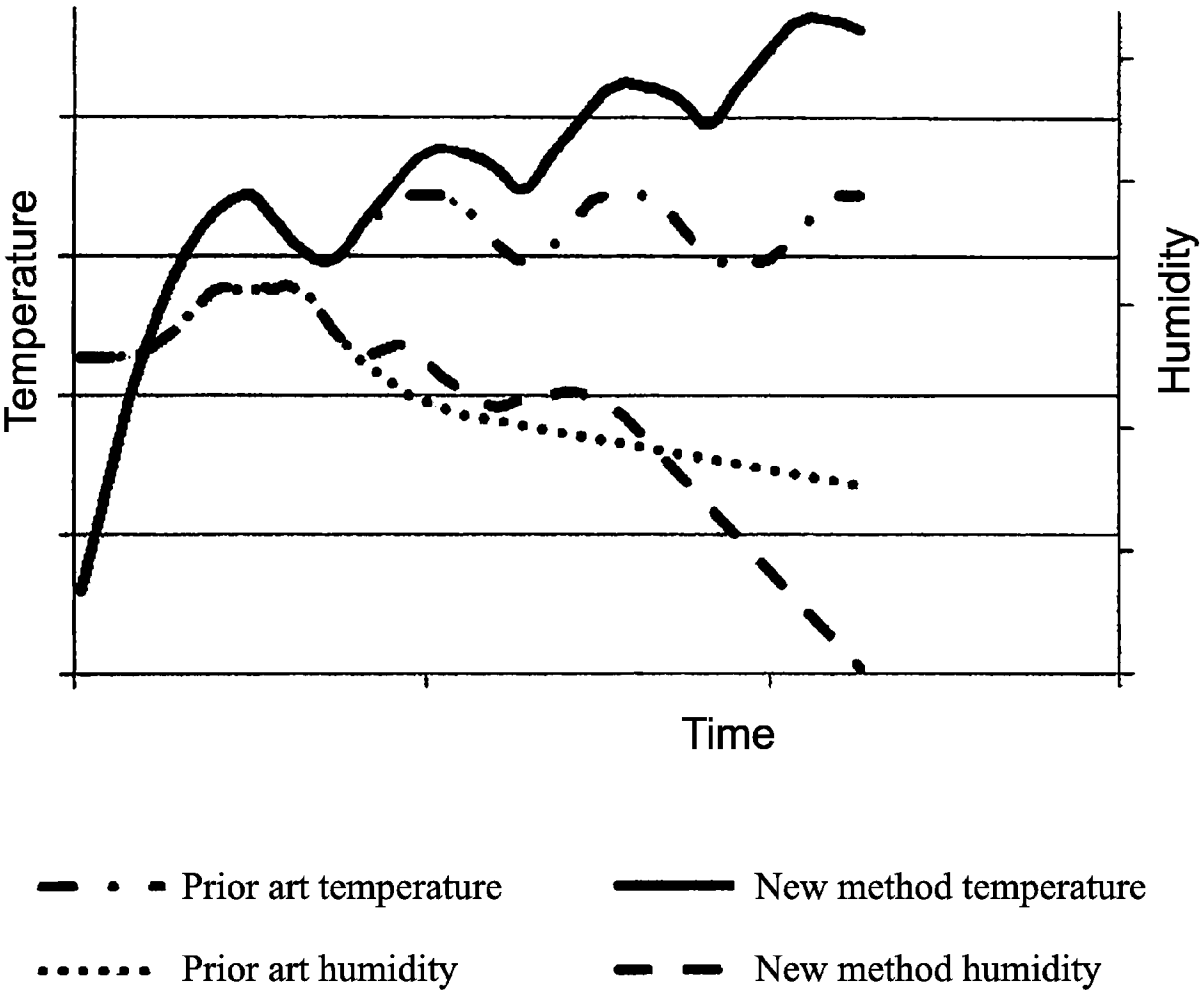

In FIG. 9 there is shown a temperature and humidity graph over time comparing operation of the apparatus described above with the corresponding operation of prior art apparatus made and operated in accordance with WO2010/007380 in which it will be seen that for a typical initial first cycle of two hours duration the temperature and humidity graphs almost exactly correspond until towards the end of the first cycle when the prior art temperature reaches the maximum preselected temperature and thereafter "hunts" within a narrow band of temperature over time. In contrast, the temperature cycle over time using the new method of the invention is characterised by an increase in temperature in response to the sensed level of humidity dropping proportionality more quickly than by using the prior art method. As a consequence, it has been found that the time taken to dry a room by a required amount is considerably less than through the use of the prior art drying system with a corresponding energy saving.

In a variant of the technique described above, fresh air can be drawn into the room, not from outside the building in which the room is located, but from another part of the building. This has the advantage that negative air pressure is created in the building because humid air is exhausted from the building faster than it is replenished. As a consequence, humid air is not forced into the external walls of the room and the negative air pressure encourages further evaporation from the building's surfaces, meaning that there is less chance of damaging the walls with humid air.

In this description, the term air is intended to encompass combinations of air and water vapour. The term humidity is intended to include relative, specific and absolute humidity measures.

What is claimed is:

1. A cyclic room drying method including initiating a room drying process including the steps of:

heating the air in the room and circulating said heated air around the room;

continually or periodically monitoring the room temperature and the humidity;

the temperature and the humidity having a preselected maximum;

exhausting the heated air in the room following the first to occur of either a) a rate of increase of temperature or humidity which approaches zero, below the preselected maximum temperature and humidity of said monitored room, or b) a predetermined time period;

introducing fresh air into the room; and, repeating the steps above until a suitably dry room is obtained.

2. The method of drying a room as recited in claim 1 wherein said exhausting step is initiated after a heating and circulation period of approximately 1 to 3 hours unless said rate of increase of temperature or humidity is attained within said period.

3. The method of drying a room as recited in claim 1 wherein the room temperature at which the exhausting occurs increases with successive drying cycles.

4. The method of drying a room as recited in claim 1, wherein said fresh air is drawn from either outside the building in which the room is located, or from another room in the building.

5. The method of drying a room as recited in claim 1, wherein the reference humidity is provided by a remote reference in the building in which the room is located.

6. The method of drying a room as recited in claim 1 in which air being drawn into the room is pre-heated to reduce the risk of condensation.

7. A drying apparatus for use in a damp or waterlogged room, the apparatus including sensing means to sense room humidity and air temperature in the room, heating means to provide heat for the room, air circulation means for selectively circulating heated air within the room or selectively exhausting warm and humid air from the room and for allowing outside ambient air into the room, the apparatus further including a circuit arranged to control the drying method as recited in claim 1.

8. The drying apparatus recited in claim 7, wherein the apparatus includes a heater, coupled via ducting to air circulation fans including an inlet fan and an outlet fan, the inlet fan selectively either recirculating air within the room until chosen temperature characteristics have been attained or time period has been reached, or, via the use of an air intake valve, drawing outside ambient air into the room to replace saturated air expelled by the exhaust fan at the end of each drying cycle.

9. The drying apparatus recited in claim 8, wherein the heater comprises an electric heater.

10. The drying apparatus recited in claim 8, wherein the circuit is in the form of processor which receives sensed signals from sensors in the room and on or in the apparatus which sense room air temperature and/or room air or other humidity.

11. The drying apparatus recited in claim 7, wherein the apparatus also includes means for recording energy used during the drying process.

12. The drying apparatus recited in claim 7, further comprising a timer for recording data at required intervals.

13. The drying apparatus recited in claim 7, wherein the apparatus is a stand alone unit and operates until it detects that the room within which it is installed is sufficiently dry.

14. The drying apparatus recited in claim 7, further comprising remote communications which indicates to a remote location that the room is sufficiently dry for the apparatus to be removed and relocated if necessary to dry another room.

15. The drying apparatus recited in claim 7, wherein said apparatus is portable and temporarily locatable in said room for said drying.

16. The drying apparatus recited in claim 7, including a heater to pre-heat outside ambient air as it is drawn into the room being dried to reduce the risk of condensation.

* * * * *